US006226947B1

(12) United States Patent
Bado et al.

(10) Patent No.: US 6,226,947 B1
(45) Date of Patent: May 8, 2001

(54) CLADDING BOARD MOUNTING SYSTEM

(75) Inventors: John Joseph Bado, Greenfield Park; John Sidney Cottier, Lugarno; Joseph Emmanuel Zarb, Bonnyrigg, all of (AU)

(73) Assignee: James Hardie Research Pty Limited (AU)

( * ) Notice: Subject to any disclaimer, the term of this patent is extended or adjusted under 35 U.S.C. 154(b) by 0 days.

(21) Appl. No.: 09/254,462

(22) PCT Filed: Sep. 5, 1997

(86) PCT No.: PCT/AU97/00582

§ 371 Date: Jun. 8, 1999

§ 102(e) Date: Jun. 8, 1999

(87) PCT Pub. No.: WO98/10151

PCT Pub. Date: Mar. 12, 1998

(30) Foreign Application Priority Data

Sep. 5, 1996 (AU) ..... PO 2159

(51) Int. Cl.[7] ..... E04B 2/88

(52) U.S. Cl. ..... 52/483.1; 52/235; 52/479; 52/511; 52/513; 52/386

(58) Field of Search ..... 52/474, 479, 489.1, 52/235, 236.7, 236.9, 480, 512, 513, 511, 506.08, 483.1, 507, 508, 379, 355, 386, 383; 403/220

(56) References Cited

U.S. PATENT DOCUMENTS

| | | | | |
|---|---|---|---|---|
| 4,058,944 | | 11/1977 | Rieger . | |
| 4,187,658 | | 2/1980 | Reinwall, Jr. . | |
| 4,307,551 | * | 12/1981 | Crandell | 52/235 |
| 4,553,366 | | 11/1985 | Guerin . | |
| 4,685,263 | * | 8/1987 | Ting | 52/235 |
| 4,866,896 | * | 9/1989 | Shreiner et al. | 52/235 |
| 5,226,274 | * | 7/1993 | Sommerstein | 52/512 |
| 5,301,484 | | 4/1994 | Jansson . | |
| 5,598,671 | * | 2/1997 | Ting | 52/235 |

FOREIGN PATENT DOCUMENTS

| | | |
|---|---|---|
| 46878 | 10/1991 | (AU) . |
| 35 05 335 A1 | 8/1986 | (DE) . |
| 3923800 A1 | 1/1991 | (DE) . |
| 42 09 834 A1 | 9/1993 | (DE) . |
| 0 625 618 A2 | 11/1994 | (EP) . |
| 0 708 213 A1 | 4/1996 | (EP) . |
| 1577648 | 10/1980 | (GB) . |
| 2067622 | 7/1981 | (GB) . |
| 64-20910 | 8/1990 | (JP) . |
| 64-22385 | 8/1990 | (JP) . |
| 64-25200 | 8/1990 | (JP) . |
| WO 90/08240 | 7/1990 | (WO) . |
| WO 91/14057 | 9/1991 | (WO) . |

* cited by examiner

*Primary Examiner*—Carl D. Friedman
*Assistant Examiner*—Winnie Yip
(74) *Attorney, Agent, or Firm*—Knobbe, Martens, Olson & Bear, LLP.

(57) ABSTRACT

An improved cladding board mounting system for mounting cladding boards (100) adjacent a surface to be concealed. Each cladding board (100) includes at least one support member (130) on the interior face (120) of the cladding board. The system further includes at least one mounting member (170) which includes an engaging formation (172) adapted for releasable engagement with a complementary engaging formation (132) of a respective support member. The mounting member also includes a second segment (174) for releasable connection to the surface to be concealed. Preferably a mounting bracket (70) extends between the surface to be clad and the mounting member (170).

32 Claims, 8 Drawing Sheets

CLADDING BOARD MOUNTING SYSTEM

TECHNICAL FIELD

The present invention relates to a cladding board mounting system and particularly but not only cladding systems using fibre cement cladding boards.

BACKGROUND ART

The invention has been developed primarily for use in mounting cladding boards to the external walls of buildings. However, it will be appreciated that the invention is not limited to this particular use and, for example, is equally suited to mounting cladding boards to the internal walls or surfaces of buildings or other like structures.

Hitherto, known cladding board mounting systems have relied upon embedded fasteners, front fixing fasteners or adhesives to mount cladding boards to walls. Each of these systems has disadvantages.

For example, embedded fasteners such as captive nuts or wire hooks are difficult and costly to produce and are inflexible in their application. Also, complicated engaging and mating assemblies are required to be attached to the surface on which the board is mounted.

Front fixing fasteners generally comprise screws inserted through the cladding board and into wooden or metal battens previously attached to the building. The major disadvantage of this system is that the exposed surface of the cladding board must be re-finished in order to hide the screw heads and give a uniform and attractive external appearance. This re-finishing is both time consuming and costly, especially where the cladding boards are mounted to multi-story buildings, as it must be performed in-situ. Moreover, several types of cladding board have outer decorative surfaces which cannot be easily or economically re-finished, if at all.

Adhesive cladding board systems avoid the re-finishing problems described above but are expensive to install due to the specialised adhesives required. Moreover, the adhesives have been prone to failure over time and falling cladding boards constitute a significant safety hazard.

The present applicant has attempted to overcome some of these difficulties by providing a new cladding board mounting system which is subject of International patent application No. PCT/AU96/00828.

This system has been at least partially successful in overcoming some of the difficulties of the prior art, however, it has also highlighted certain problems.

In the cladding board system subject of the abovementioned International patent application, V-shaped grooves are formed in the cladding board to receive complimentary shaped mounting strips. These mounting strips are releasably held in the grooves and protrude from the rear surface of the board for connection to the wall to be clad. These strips, however, make the board difficult to stack and can be damaged or cause damage to the board during storage or transport. Further, the grooves formed in the board for receiving the mounting strips can weaken the board and lead to damage as the board flexes in use or during transportation and installation.

Further, the various grooves in the cladding board must align with each other precisely. As will be apparent to those skilled in the art, quite apart from aesthetic considerations, uneven loading or positioning of the cladding board can lead to various structural difficulties.

It is an object of the present invention to ameliorate one or more of these deficiencies of the prior art or at least provide a commercial alternative to the prior art cladding systems.

DISCLOSURE OF THE INVENTION

In a first aspect, the present invention provides a cladding board mounting system for mounting cladding boards adjacent to a surface to be concealed, said system comprising:

at least one support member adapted to be attached to an interior mounting face of said cladding board, and at least one mounting member including a first segment having an engaging formation adapted for releasable engagement with a complementary engaging formation in a respective one of said support menber(s), and a second segment of the mounting member being adapted for releasable connection to the surface to be concealed, the engaging formation of the first segment of each mounting member having a V cross-sectional shaped channel adapted to slidably engage a corresponding pair of inwardly directed mutually divergent recesses formed as the complementary engaging formation in the respective support member.

Preferably each support member is in the form of a substantially 2-dimensional support layer adapted to be attached to the interior mounting face of the cladding board.

The support layer may cover substantially the entire interior mounting face of the cladding board or alternatively, a number of support layers or strips may be attached to the interior mounting face of the cladding board. Preferably the support member extends substantially across the entire width of the cladding board. By providing the complementary engaging formations in a support member attached to the cladding board rather than in the cladding board itself the opportunity for damage to both the board and mounting members is not only reduced but the support member actually reinforces the cladding board by reducing flexure.

The support member(s) may be formed from the same material as the cladding board or other materials such as plastic, steel etc, but aluminium is particularly preferred and may be glued or mechanically fastened or both to the interior mounting face of the cladding board. The mounting member may similarly be constructed of aluminium, plastic, steel etc.

In another embodiment, the first segment of the mounting member comprises a V cross-sectional channel adapted to slidably engage a pair of mutually divergent recesses formed in the respective support member.

In another embodiment, the second segment of each mounting member comprises a downwardly extending portion configured to facilitate releasable connection of the mounting member to the surface to be concealed. Preferably at least one mounting member includes an additional extended portion for fixed or non adjustable attachment to the surface to concealed using, for example, screws or other suitable fixing means.

In still a further embodiment, the cladding board mounting system includes a plurality of mounting brackets adapted to be attached to the surface to be concealed, each mounting bracket providing a recess for releasable engagement with the mounting member. A resilient mounting means may be provided between the cladding board and the surface to be concealed. This resilient means is preferably configured to permit limited relative movement between the cladding board and surface to be concealed. Most preferably the resilient mounting means comprises a rigid mounting bracket adapted to be attached to the surface to be concealed with an exterior resilient portion adapted to abut the support member or cladding board and an interior resilient portion adapted to abut the second segment of the mounting member.

In another embodiment, these interior and exterior resilient portions are offset in the direction of load of the cladding board on the brackets. In one preferred form the exterior resilient portion is vertically offset below the interior resilient portion.

The support members may be attached to the cladding board by any appropriate mechanism. In a preferred embodiment, however, the support member is attached to the cladding board by a plurality of discrete fastening means positioned across the width of the cladding board and partially embedded in the cladding board. Preferably, undercut key hole slots are formed in the interior face of the cladding board for captively retaining a portion of said discrete fastening means. More preferably, the captively retained portion of the fastening means comprises internally threaded nuts or threaded frusto-conical discs adapted to be inserted into said key hole slots and engage corresponding externally threaded fasteners that interact with the support member to secure it to the cladding board.

In a second aspect, the present invention provides a cladding board mounting system for mounting cladding boards adjacent to a surface to be concealed, said system comprising:

a plurality of reinforcement members adapted to be attached to the cladding board, a plurality of resilient mounting means adapted to attach to the surface to be concealed, and a plurality of mounting members adapted to extend between and releasably engage respective reinforcement members and resilient mounting means, wherein said resilient mounting means each comprising a rigid mounting bracket adapted to be attached to the surface to be concealed with an exterior resilient portion adapted to abut the mounting member, the mounting means being configured to provide retaining support to the cladding board but allow limited movement of the cladding board relative to the surface to be concealed.

In another embodiment, these interior and exterior resilient portions are offset in the direction of load of the cladding board on the brackets. In one preferred form the exterior resilient portion is vertically offset below the interior resilient portion.

Preferably, at least one of the mounting members includes means for fixed attachment to the surface to be concealed by means, for example, of screws or other suitable fasteners. Desirably, this mounting member is secured adjacent the top of the cladding board so that the fixed attachment is overlaid by the cladding board located directly thereabove.

In a preferred embodiment, at least one of the mounting members includes a generally downwardly extending hook portion adapted to releasably engage the interior resilient portion of the mounting bracket and a generally upwardly extending securing portion for fixed attachment to the surface to be concealed. Desirably, the upwardly extending securing portion is also configured to act as a horizontal flashing to substantially seal the gap between vertically adjacent cladding boards.

Preferably, the mounting members are adapted to releasably engage the reinforcing members by means of longitudinally extending spline formations on the one member adapted to engage appropriately sized slot formations on the other of said members.

In preferred embodiments, each reinforcement member and mounting member extends, in use, generally horizontally relative to the surface to be clad.

The cladding board is preferably constructed of fibre reinforced cement.

BRIEF DESCRIPTION OF THE DRAWINGS

So that the nature of the present invention may be more clearly understood, preferred embodiments will now be described, by way of example only, with reference to the accompanying drawings in which.

BEST MODE(S) FOR CARRYING OUT THE INVENTION

Figure 1:
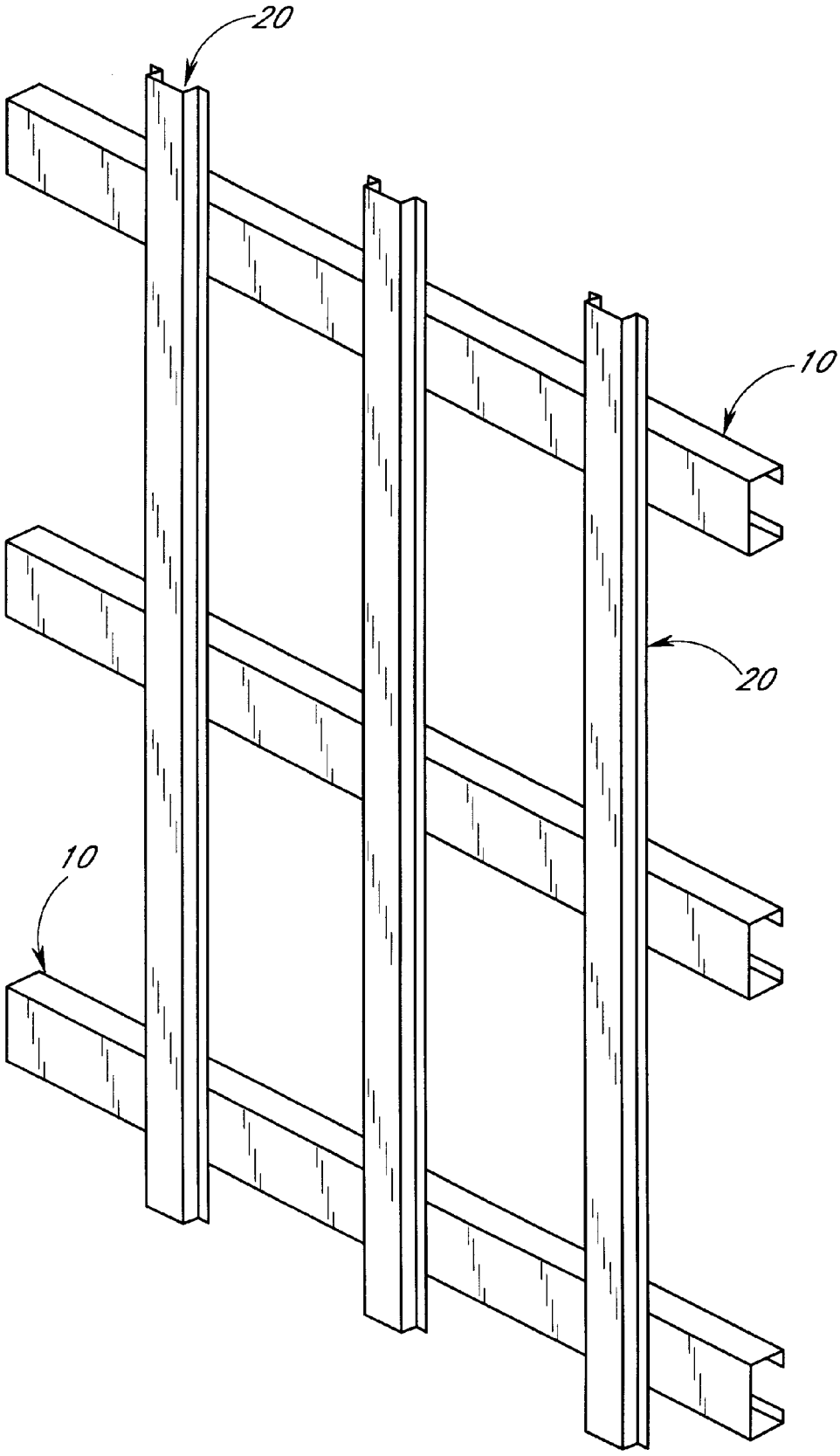
FIGS. 1, 2 and 3 are perspective views of various stages of construction of the cladding board mounting system according to an embodiment of the present invention.

FIG. 1 is a perspective view of the first stage of the cladding system. The cladding system starts with a support framework over the wall to be concealed. This framework includes a plurality of horizontally arranged steel channels or girts 10. On an exterior side of these girts 10 a plurality of mutually parallel vertically arranged channel members or "top hats" 20 are arranged.

Figure 2:
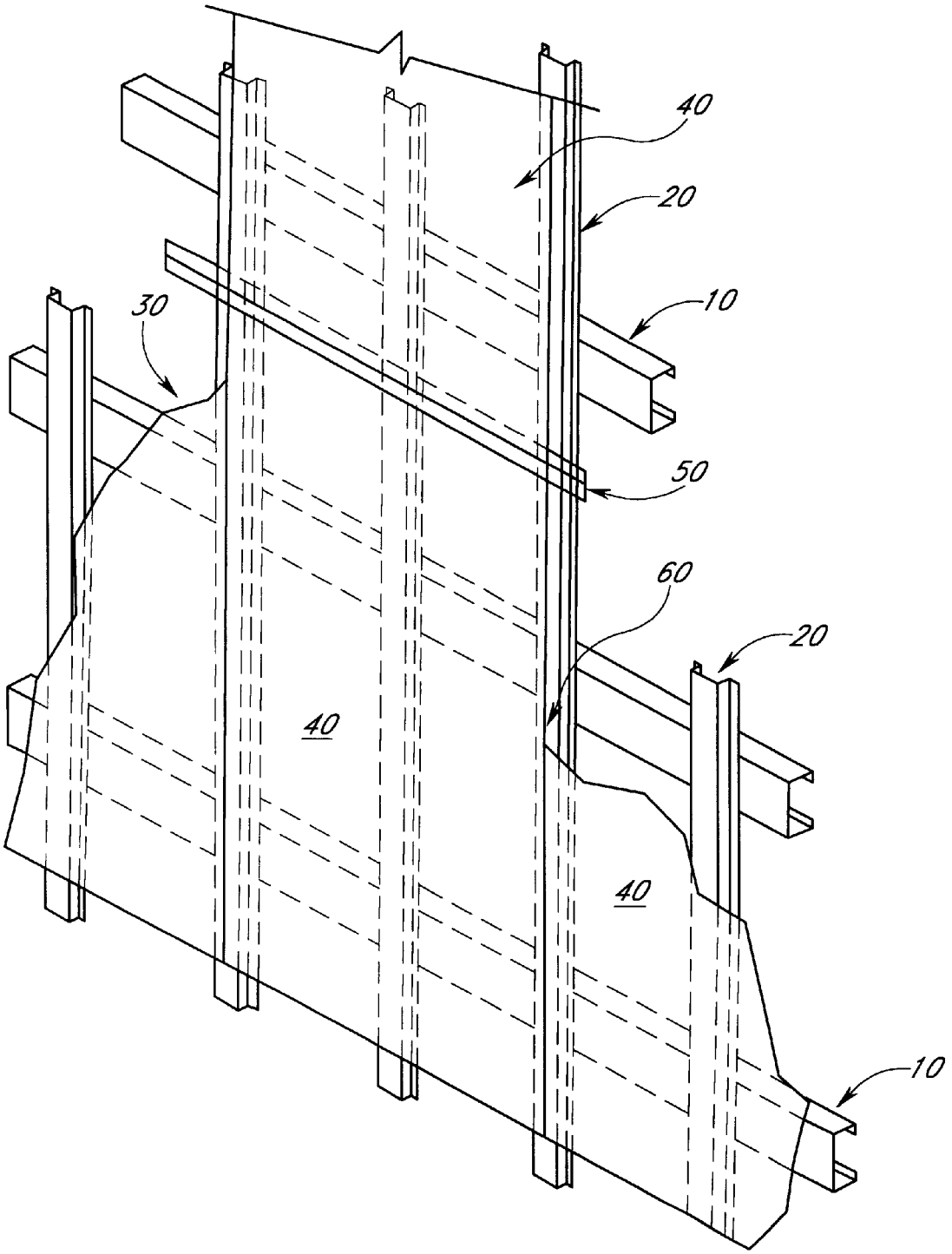

Turning now to FIG. 2, the next stage is the optional attachment of a moisture resistant barrier 30 to top hats 20. In the embodiment shown, this moisture resistant barrier 30 is provided by a plurality of fibre cement sheets 40 fastened to top hats 20 however other moisture resistant barriers such as building paper or sarking etc can be used. The joints between these fibre reinforced cement sheets 40 may be sealed by appropriate horizontal flashing 50 and/or vertical flashing/jointing 60.

The next step in the preferred cladding board construction is the positioning and attachments of mounting means to the framework to support the cladding boards. A plurality of mounting brackets 70 is attached to this fibre reinforced cement sheet 40 as shown in FIGS. 3 and 4.

Figure 8:
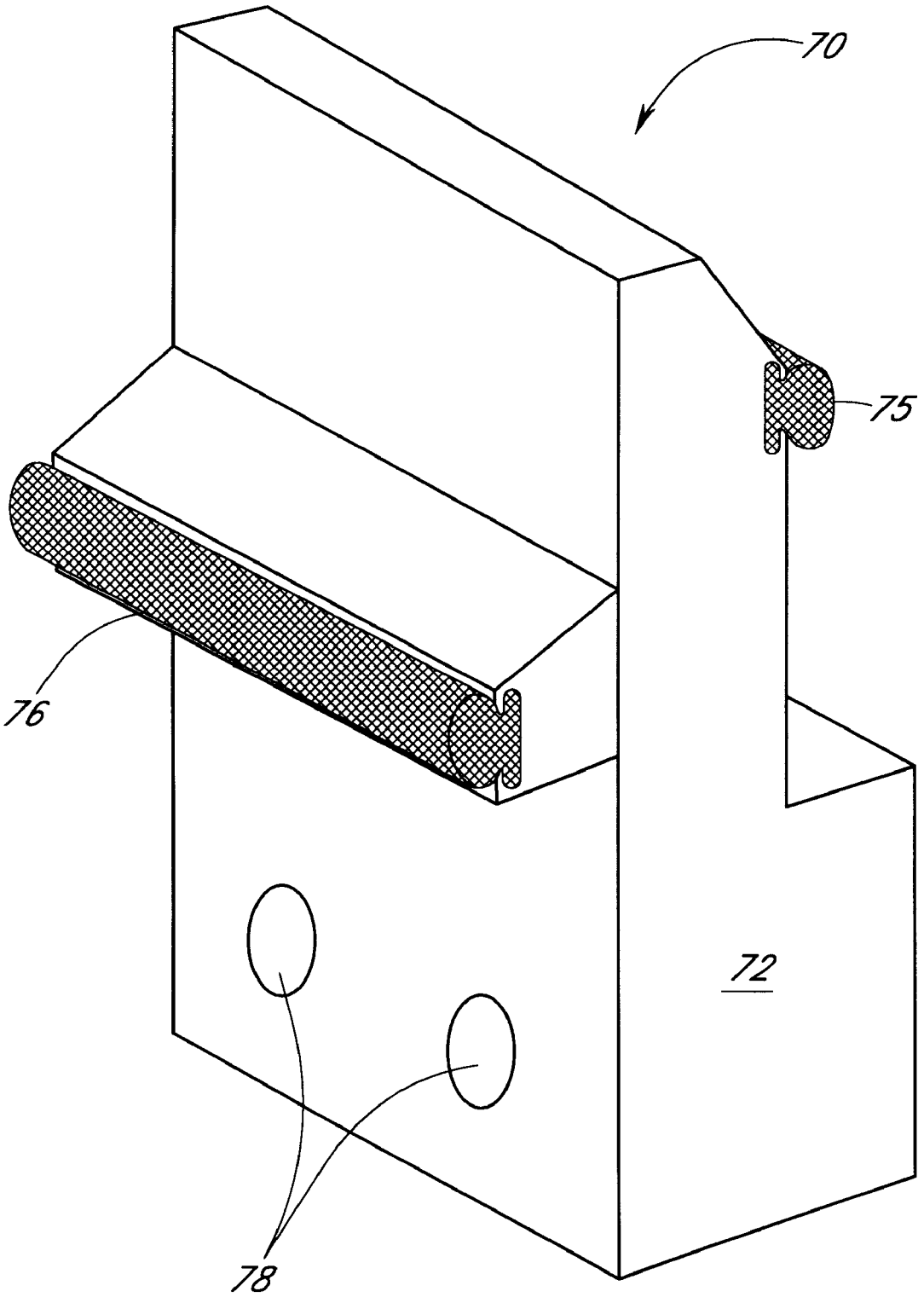
FIG. 8 is a perspective view of a mounting bracket for use with the inventive cladding board mounting system according to still a further embodiment of the present invention.

A perspective view of the preferred construction of the mounting brackets can be seen in FIG. 8. The mounting bracket 70 preferably comprises a rigid bracket portion 72 with an interior resilient portion 74 and an exterior resilient portion 76. In the drawing, resilient portions 74, 76 are provided by rubber or other unitary elastomeric material. Other resilient means such as leaf or coil springs or spring clips may also be used. The rigid bracket portion 72 has aperture(s) 78 therethrough for passage of a screw, nail or other fastening means for attaching the mounting bracket to the framework.

Figure 3:
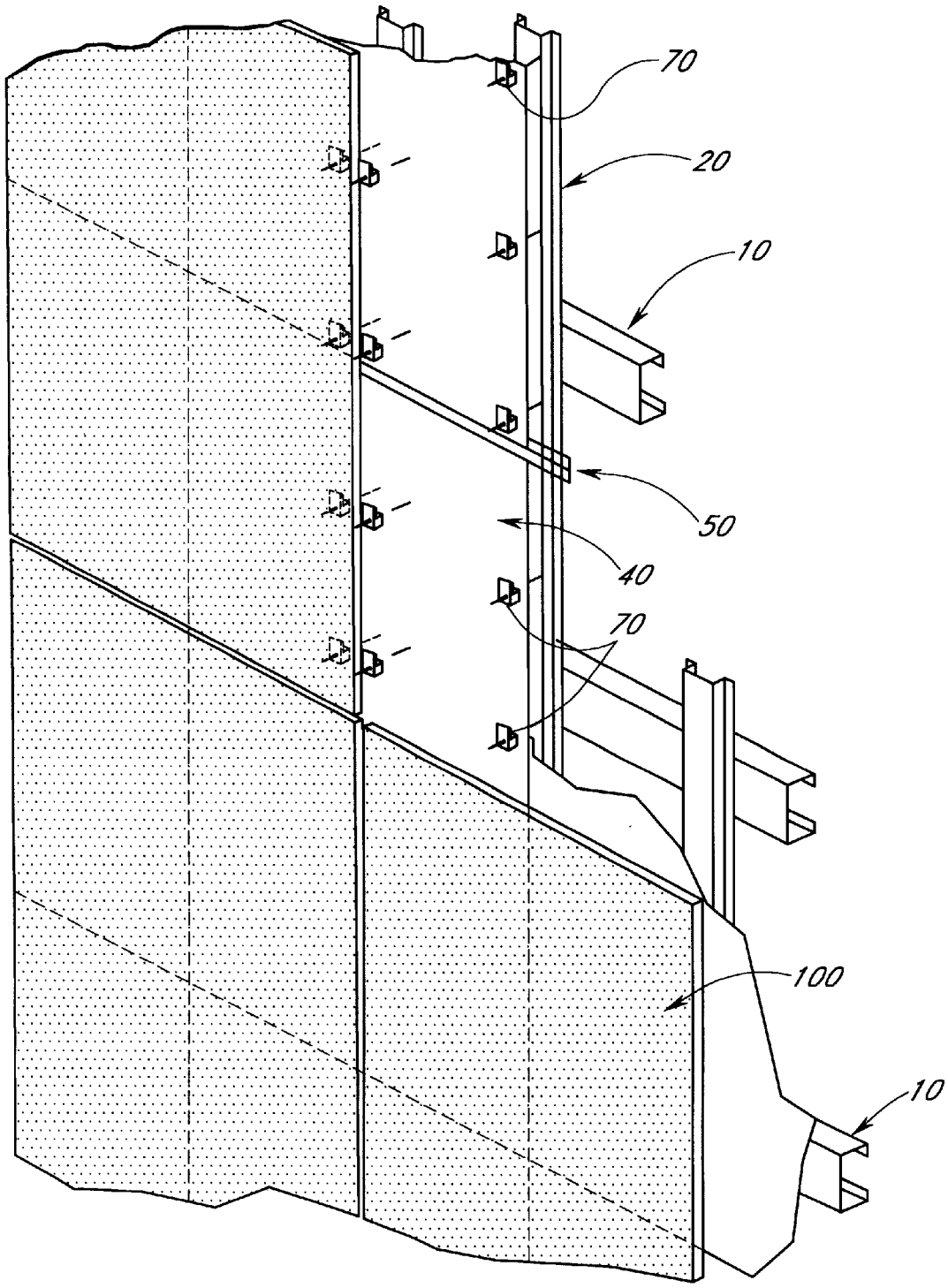

As seen more clearly in FIG. 3, each mounting bracket 70 is fastened through the fibre reinforced cement sheet 40 to a top hat 20. The number and configuration of the mounting brackets 70 will depend on a number of factors including the size and weight of the cladding board to be supported thereon. To ensure correct alignment of the various mounting brackets 70 a template may be used. This template is laid over the fibre reinforced cement sheet 40 and marked with appropriate positions for the mounting brackets 70.

Figure 4:
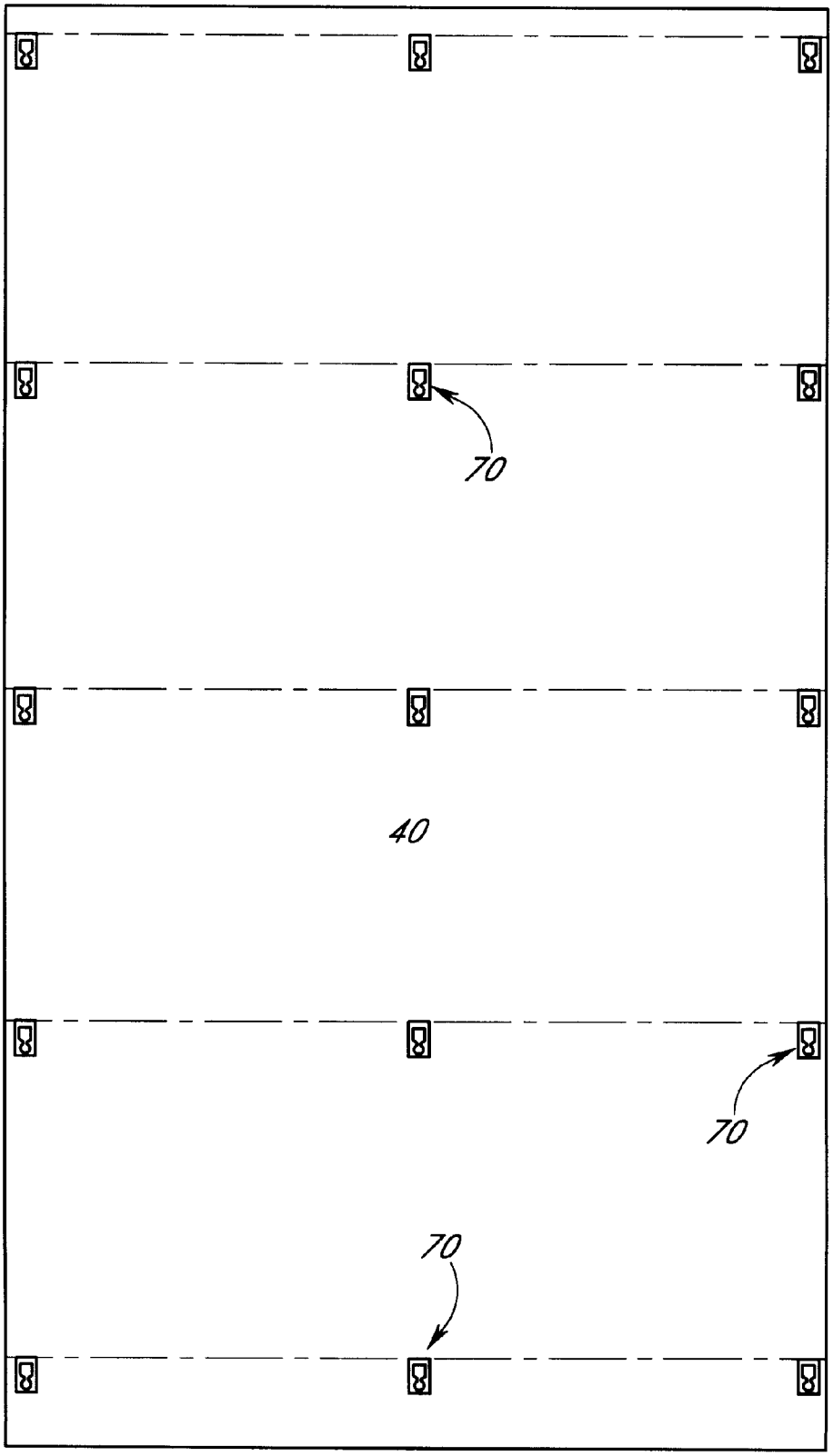
FIG. 4 is a front elevational view of a moisture resistant barrier which forms part of the cladding board mounting system shown in FIGS. 1–3.

In the embodiment shown in FIGS. 3 and 4 there are three mounting brackets on each level of the sheet 40. If desired, one can provide for more mounting brackets at the top, for particularly large cladding boards 100, and less at the bottom since the lower mounting brackets are essentially for wind loading only. The mounting brackets 70 at the lower end of each cladding board serve little function in the way of vertically supporting the cladding board. For example if the cladding board 100 was particularly large or wider an operator may determine that 5 or 6 mounting brackets were required at the top with a lower number eg 2 or 3 at the lower end.

Figure 5:
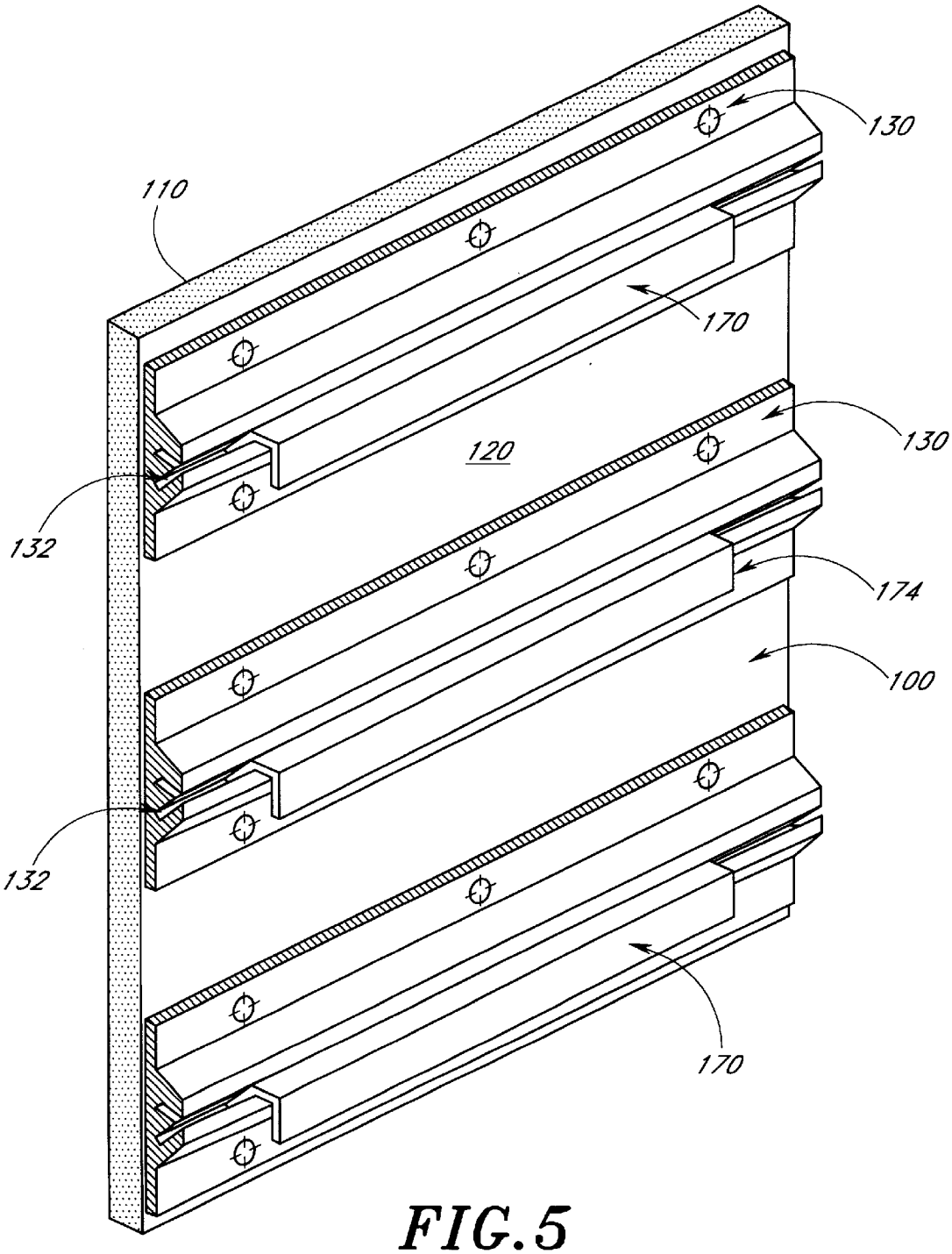
FIG. 5 is perspective view of a cladding board for use with the inventive cladding board mounting system according to another embodiment of the present invention.

The inventive cladding board is shown in FIG. 5. The cladding board comprises board portion 100 having an exterior face 110 and interior face 120. Attached to the interior face 120 of the cladding board 100 is the support member 130.

The support member(s) includes an engaging formation 132. This engaging formation 132 is preferably provided by a pair of mutually divergent recesses which, as will be discussed below, are configured to mate with an engaging formation in a mounting member.

It should be noted that as shown in the drawings, the engaging formation 132 is not formed or cut directly in the cladding board but instead is formed or cut in one or more support members 130 attached to the interior mounting face of the cladding board 100.

In this embodiment several support members 130 are provided in the form of a number of substantially parallel mutually spaced apart support strips.

As will be understood by persons skilled in the art, cutting or forming the engaging formation 132 directly in the board may affect the structural integrity of the board. In particular, when such cladding boards 100 are handled they tend to flex and any recesses or channels in the board itself may concentrate the stress applied to the cladding board along the line of the channel. This may lead to weakening or cracks appearing in the cladding board in the area of the channels or recesses.

By providing one or more support members 130 on an interior mounting face of the cladding board 100, the structural integrity of the cladding board 100 is maintained and in fact reinforced. This arrangement reduces flexing of the cladding board 100 during handling. Even in the event of cracks appearing in the support members 130, these cracks do not propagate into the cladding board due to the laminated structure of the support member(s)/cladding board.

As mentioned above, the support member(s) may be formed from the same material as the cladding board or, alternatively, any other suitable material such as plastic, steel etc, however, aluminium is preferred.

These support members 130 may be fastened to-the interior face 120 of the cladding board 100 by any appropriate mechanism such as gluing, mechanical fastening etc. One particularly preferred mechanism for attaching the support members 130 to the cladding board 100 is shown in FIG. 7.

Figure 6:
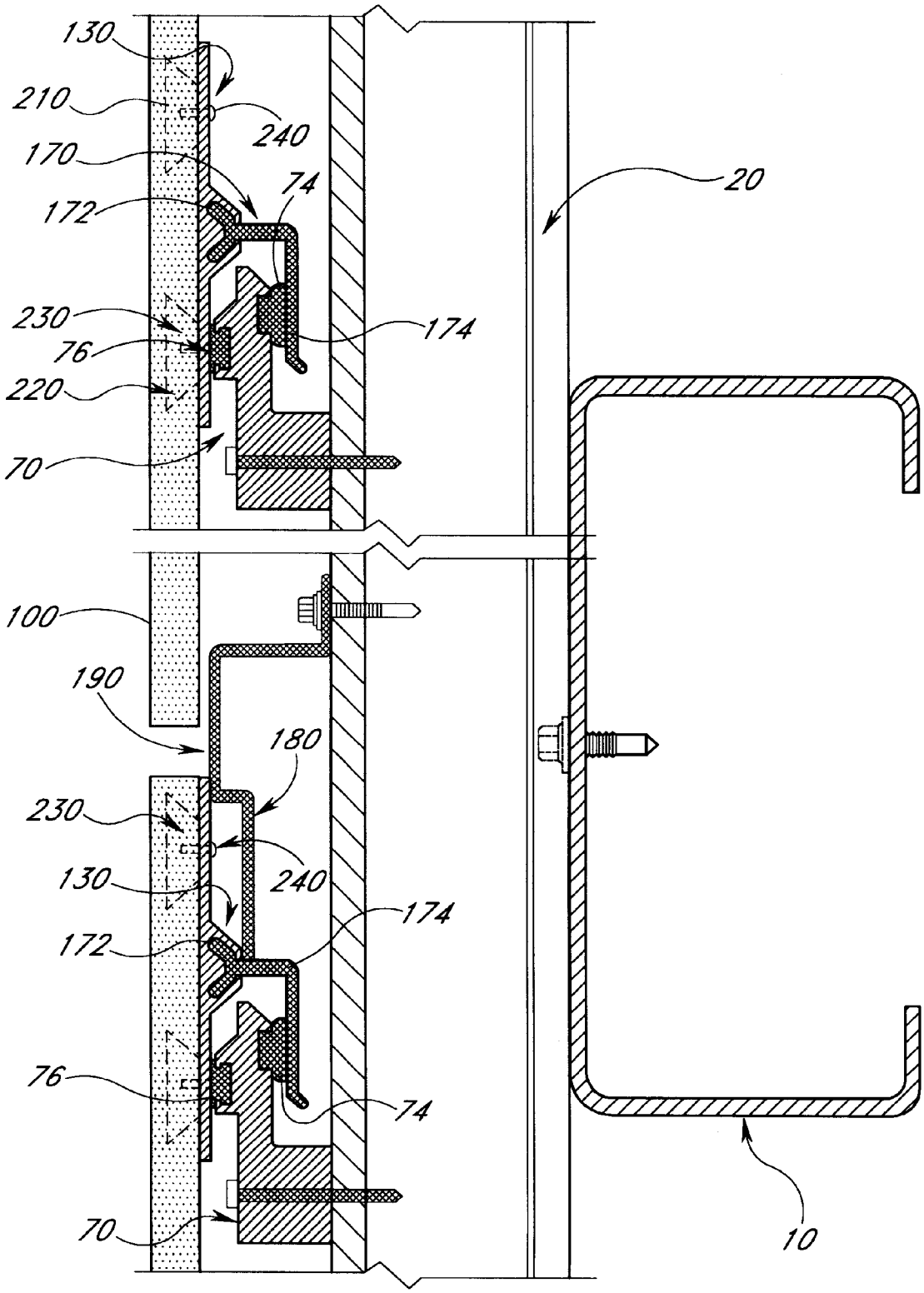
FIG. 6 is an end elevational view of the cladding mounting system according to a further embodiment of the present invention.
Figure 7:
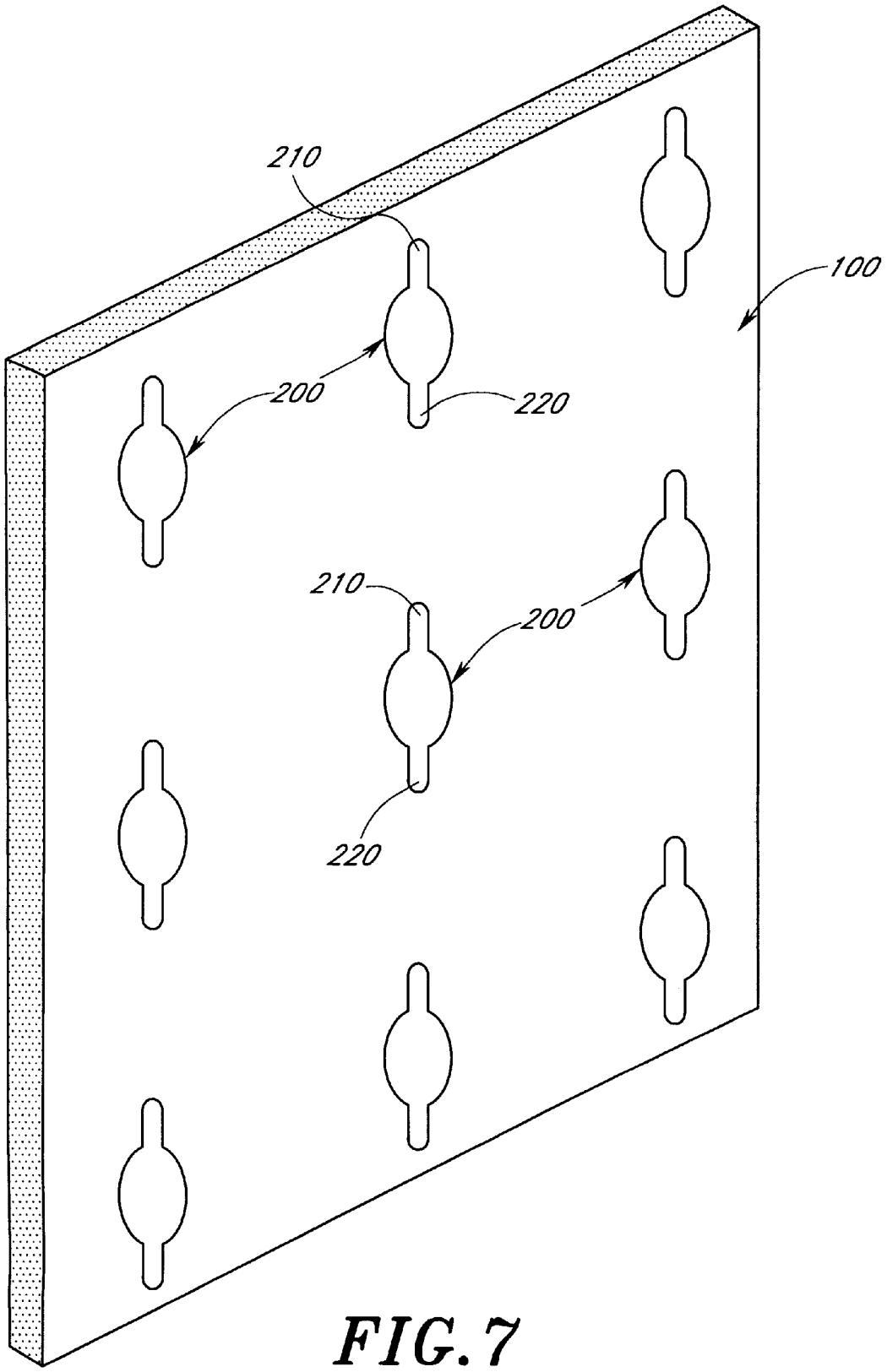
FIG. 7 is a perspective view of an arrangement for mounting support members on the cladding board in accordance with still a further embodiment of the present invention.

As shown in FIGS. 6 and 7 a series of blind or undercut keyhole slots 200 are formed in the interior face of the cladding board 100. These slots 200 have mutually opposed undercut portions 210 and 220 adapted to receive the small threaded disks or captive nuts 230. These threaded nuts or disks are adapted to engage with threaded fasteners 240. As shown more clearly in FIG. 6 these threaded fasteners 240 pass through support members 130 to engage the disk or nut 230 embedded in the cladding board and thereby hold the support member 130 flush against the interior face 120 of the cladding board 100. This mechanical attachment of the support members 130 to the cladding board may be assisted with glue. Preferably the fastening of the support members 130 to cladding board 100 is accomplished off-site and the cladding boards 100 are transported with the support members 130 in place.

As mentioned above, the support members 130 act to reinforce the cladding board to reduce flexure and damage during transportation and installation. They are also extremely useful for hanging the cladding board during painting.

Once on site, mounting members or splines 170 are slidably inserted into the support members 130 as shown in FIG. 5. The mounting members 170 include a first segment having an engaging formation 172 adapted to mate with the complementary engaging formation 132 in the support member 130. In the embodiment shown the engaging formation of the mounting member is a V cross-sectional channel 172 configured to engage the pair of mutually divergent recesses 132 formed in the support member 130. The second segment of the mounting member 170 is a downwardly directed extension 174 to releasably engage the mounting brackets 70. The support members 130 and/or mounting members 170 preferably extend substantially across the entire width of the cladding board. Once the mounting members 170 are in position in the support members 130, the ends of the support members 130 may be crimped or sealed to prevent the mounting members 170 from sliding out.

To mount the cladding board 100 it is simply lowered onto the various mounting brackets 70 as shown more clearly in FIG. 6. In one embodiment, packing material may be provided on the top edge of an already mounted cladding board, so that the cladding board to be mounted is lifted onto the mounting brackets 70 directly above and lowered to contact the packing material. This ensures the cladding board to be mounted is parallel with the cladding board directly below. As shown in FIG. 6 the resilient portions 74, 76 which are deformable, are arranged to abut the support member 130 or cladding board 100 on an exterior side and the mounting member 170 on an interior side. The mounting bracket 70 and resilient gripping means 74, 76 are arranged to hold and support the cladding board but allow limited movement of the cladding board 100 relative to the surface to be concealed. Preferably there is no contact between the mounting bracket 70 and the support member 130 or mounting member 170 other than through resilient portions 74, 76. This allows the cladding board to "float" on the mounting brackets since there is no abutment of the rigid bracket portion 72 on the mounting member 170 or support member 130.

The preferred arrangement for the resilient portion 74 and 76 shown in FIG. 6 is to offset these portions in the direction of load of the cladding board 100 on the brackets 70. This configuration allows the cladding board to move in a direction parallel to the surface to be concealed. By action of the load of the cladding board on the resilient portion 74, 76 the cladding board is held in its new position.

Such an arrangement has several advantages. Firstly, it allows the position of the cladding board 100 to be altered slightly to make up for any minor misalignment of the cladding board system. Further, the resilient portions 74, 76 act as a shock absorber for the cladding board. To explain, on the exterior of the building, the cladding boards 100 may be exposed to high wind, rain and other natural forces. The cladding boards 100 will move in response to these natural forces. If the cladding board 100 is rigidly attached to the mounting brackets 70, any flexure of the cladding board may cause damage. With the present inventive resilient portions 74, 76 between the mounting brackets 70 and cladding board 100, vibratory movement of the cladding board toward and away from the surface to be concealed or movement in the plane of the board is dampened somewhat by these resilient portions 74, 76 thereby reducing the possibility of damage to the cladding board. As mentioned above, the support strips 130 and mounting members 170 which extend across the entire width of the cladding board, also reduce flexure of the cladding board in situ.

The arrangement also allows the board 100 to move in situ, to a limited extent and relative to the surface to be concealed, on the mounting brackets 70 to relieve any internal stresses acting on the board.

In a preferred embodiment, the uppermost mounting member 170 of each cladding board comprises an additional upstanding portion 180. This upstanding portion 180 is adapted to be attached to the top hats 20 through fibre cement sheet 40. This upstanding portion 180 serves several purposes. Firstly, it is used to provide additional support for the cladding board and correctly position and fix the cladding board 100 to the top hats 20. It also provides a horizontal flashing portion 190 to substantially seal the gap between vertically adjacent cladding boards, as shown in FIG. 6.

Once the cladding board is approximately in place, vertical and horizontal flashing may be positioned between the just mounted cladding board and the surrounding boards. This flashing reduces water ingress behind the cladding board and helps to stop vermin entering the space between the fibre cement water resistant layer 30 and the cladding boards 100. Since it is possible to adjust the position of the cladding board 100 prior to fixing the upstanding mounting portion 180, it is possible to mechanically seal or flash the various joints between the cladding boards. Conventional cladding systems use sealants or gaskets which tend to degrade or fail after a few years when exposed to the elements. With the inventive cladding board system, however, since the cladding board may be moved on the mounting bracket 70 until fixed via upstanding mounting portion 180, it is possible to manipulate the position of the board so that it abuts the mechanical flashing thereby providing a long lasting vermin and moisture resistant barrier which will not degrade to anywhere near the extent of conventional sealants or gaskets.

As shown more clearly in FIG. 3, it is also preferred that the cladding boards 100 are mounted offset relative to the fibre cement water resistant sheets 40. By offsetting the joins of the cladding boards 100 with the sheets 40, it is more difficult for water to pass between both the cladding boards 100 and fibre cement sheets 40 toward the steel girts 10 and top hats 20.

In the embodiment shown, the support members 130 and mounting members 170 extend substantially horizontally. Equally these support members and mounting members may be positioned vertically or diagonally to support cladding boards 100.

Also in the embodiments shown both the support member 130 and mounting member 170 extend substantially across the entire width of the cladding board 100. As an alternative the cladding board 100 may include a plurality of support members extending only part way across the cladding board or even individual support members each positioned to releasably engage a matching number of mounting brackets 70 via a respective mounting members 170.

As a further embodiment, the mounting member 170 may be provided to extend substantially across the entire width of the cladding board 100 and engage a plurality of substantially colinear support members spaced across the cladding board.

Either prior to or after the cladding boards are mounted they may painted or covered with any particular finish desired. Preferably the cladding boards are constructed from fibre reinforced cement (frc). The frc cladding boards allow for a greater range of finishes than do conventional wooden or metal cladding sheets.

Although the invention has been described with reference to specific examples, it will be appreciated by those skilled in the art that the invention may be embodied in many other forms.

What is claimed is:

1. A cladding board mounting system for mounting cladding boards adjacent to a surface to be concealed, said system comprising:

at least one support member adapted to be attached to an interior mounting face of said cladding board, and at least one mounting member including a first segment having an engaging formation adapted for releasable engagement with a complementary engaging formation in a respective one of said support member(s), and a second segment of the mounting member being adapted for releasable connection to the surface to be concealed, the engaging formation of the first segment of each mounting member having a V cross-sectional shaped channel adapted to slidably engage a corresponding pair of inwardly directed mutually divergent recesses formed as the complementary engaging formation in the respective support member, wherein each support member is formed by a substantially two-dimensional support layer adapted to be attached to the interior mounting face of the cladding board.

2. A cladding board mounting system as claimed in claim 1 wherein the support layer substantially covers the entire interior mounting face of the cladding board.

3. A cladding board mounting system for mounting cladding boards adjacent to a surface to be concealed, said system comprising:

at least one support member adapted to be attached to an interior mounting face of said cladding board, and at least one mounting member including a first segment having an engaging formation adapted for releasable engagement with a complementary engaging formation in a respective one of said support member(s), and a second segment of the mounting member being adapted for releasable connection to the surface to be concealed, the engaging formation of the first segment of each mounting member having a V cross-sectional shaped channel adapted to slidably engage a corresponding pair of inwardly directed mutually divergent recesses formed as the complementary engaging formation in the respective support member, wherein each support member comprises a strip extending substantially across the entire width of the cladding board.

4. A cladding board mounting system for mounting cladding boards adjacent to a surface to be concealed, said system comprising:

at least one support member adapted to be attached to an interior mounting face of said cladding board, and at least one mounting member including a first segment having an engaging formation adapted for releasable engagement with a complementary engaging formation in a respective one of said support member(s), and a second segment of the mounting member being adapted for releasable connection to the surface to be concealed, the engaging formation of the first segment of each mounting member having a V cross-sectional shaped channel adapted to slidably engage a corresponding pair of inwardly directed mutually divergent recesses formed as the complementary engaging formation in the respective support member, wherein a resilient mounting means is provided between the cladding board and the surface to be concealed, wherein the resilient mounting means is adapted to permit limited relative movement between the cladding board and the surface to be concealed, and wherein the resilient mounting means comprises a rigid mounting bracket adapted to be attached to the surface to be concealed with an exterior resilient portion adapted to abut the support member or cladding board, and an interior resilient portion adapted to abut the second segment of the mounting member.

5. A cladding board mounting system as claimed in claim 4 wherein said interior and exterior resilient portions are offset in the direction of load of the cladding board on the brackets and configured to thereby hold the cladding board in position by action of the load following movement of the cladding board in a plane parallel to the surface to be concealed.

6. A cladding board mounting system for mounting cladding boards adjacent to a surface to be concealed, said system comprising:

at least one support member adapted to be attached to an interior mounting face of said cladding board, and at least one mounting member including a first segment having an engaging formation adapted for releasable engagement with a complementary engaging formation in a respective one of said support member(s), and a second segment of the mounting member being adapted for releasable connection to the surface to be concealed, the engaging formation of the first segment of each mounting member having a V cross-sectional shaped channel adapted to slidably engage a corresponding pair of inwardly directed mutually divergent recesses formed as the complementary engaging formation in the respective support member.

7. A cladding board mounting system as claimed in claim 6 wherein each support member is formed by a substantially two-dimensional support layer adapted to be attached to the interior mounting face of the cladding board.

8. A cladding board mounting system as claimed in claim 6 wherein the support layer substantially covers the entire interior mounting face of the cladding board.

9. A cladding board mounting system as claimed in claim 6 wherein each support member comprises a strip extending substantially across the entire width of the cladding board.

10. A cladding board mounting system as claimed in claim 6 wherein the second segment of each mounting member comprises a downwardly extending portion configured to facilitate releasable connection of the mounting member to the surface to be concealed.

11. A cladding board mounting system as claimed in claim 6 wherein at least one of the mounting members includes an additional extended portion for fixed attachment to the surface to be concealed.

12. A cladding board mounting system as claimed in claim 6 further including a plurality of mounting brackets adapted to be attached to the surface to be concealed, each mounting bracket providing a recess for releasable engagement with the mounting member.

13. A cladding board mounting system as claimed in claim 6 wherein a resilient mounting means is provided between the cladding board and the surface to be concealed.

14. A cladding board mounting system as claimed in claim 13 wherein the resilient mounting means is adapted to permit limited relative movement between the cladding board and the surface to be concealed.

15. A cladding board mounting system as claimed in claim 13 wherein the resilient mounting means comprises a rigid mounting bracket adapted to be attached to the surface to be concealed with an exterior resilient portion adapted to abut the support member or cladding board, and an interior resilient portion adapted to abut the second segment of the mounting member.

16. A cladding board mounting system as claimed in claim 15 wherein said interior and exterior resilient portions are offset in the direction of load of the cladding board on the brackets.

17. A cladding board mounting system as claimed in claim 15 wherein the exterior resilient portion is vertically offset below the interior resilient portion.

18. A cladding board mounting system as claimed in claim 6 including a cladding board constructed from fibre reinforced cement.

19. A cladding board mounting system as claimed in claim 18 wherein each support member is attached to the cladding board by a plurality of discrete fastening means positioned across the width of the cladding board and partially embedded in the cladding board.

20. A cladding board mounting system according to claim 19 wherein undercut key hole slots are formed in the interior face of the cladding board for captively retaining a portion of said discrete fastening means.

21. A cladding board mounting system according to claim 20 wherein said captively retained portion of the fastening means comprise internally threaded nuts or threaded frustoconical discs adapted to be inserted into said key hole slots and engage corresponding externally threaded fasteners that interact with the support member to secure it to the cladding board.

22. A cladding board mounting system according to claim 18 wherein the support member is attached to the cladding board with adhesive.

23. A cladding board mounting system as claimed in claim 6 wherein each support member and mounting member extends, in use, generally horizontally relative to the surface to be clad.

24. A cladding board mounting system according to claim 6 wherein the V cross-sectional shaped channel defines two fins, each of said fins being adapted to slidably engage a respective one of the mutually divergent recesses.

25. A cladding board mounting system for mounting cladding boards adjacent to a surface to be concealed, said system comprising:

a plurality of reinforcement members adapted to be attached to the cladding board, a plurality of resilient mounting means adapted to attach to the surface to be concealed, and a plurality of mounting members adapted to extend between and releasably engage respective reinforcement members and resilient mounting means, wherein said resilient mounting means each comprising a rigid mounting bracket adapted to be attached to the surface to be concealed with an exterior resilient portion adapted to abut the reinforcement member or the cladding board and an interior resilient portion adapted to abut the mounting member, the mounting means being configured to provide retaining support to the cladding board but allow limited movement of the cladding board relative to the surface to be concealed.

26. A cladding board mounting system according to claim 25 wherein at least one of the mounting members includes means for fixed attachment to the surface to be concealed.

27. A cladding board mounting system according to claim 26 wherein at least one of the mounting members includes a generally downwardly extending hook portion adapted to releasably engage the interior resilient portion of the mounting bracket and a generally upwardly extending securing portion for fixed attachment to the surface to be concealed.

28. A cladding board mounting system according to claim 27 wherein said generally upwardly extending securing portion is also configured to act as a horizontal flashing to substantially seal the gap between vertically adjacent cladding boards.

29. A cladding board mounting system as claimed in claim 25 wherein the interior and exterior resilient portions are offset in the direction of load of the cladding board on the bracket.

30. A cladding board mounting system as claimed in claim 29 wherein the exterior resilient portion is vertically offset below the interior resilient portion.

31. A cladding board mounting system as claimed in claim 25 wherein each reinforcement member and mounting member extends, in use, generally horizontally relative to the surface to be clad.

32. A cladding board mounting system according to claim 25 wherein the mounting members are adapted to releasably engage the reinforcing members by means of longitudinally extending spline formations on the one member adapted to engage appropriately sized slot formations provided on the other of said members.

* * * * *